US008162060B2

(12) United States Patent
Randazzo

(10) Patent No.: US 8,162,060 B2
(45) Date of Patent: Apr. 24, 2012

(54) GAS-LIFT VALVE AND METHOD OF USE

(75) Inventor: Vic Arthur Randazzo, Grand Prairie, TX (US)

(73) Assignee: Eagle Gas Lift, LLC., New Iberia, LA (US)

( * ) Notice: Subject to any disclaimer, the term of this patent is extended or adjusted under 35 U.S.C. 154(b) by 277 days.

(21) Appl. No.: 12/603,383

(22) Filed: Oct. 21, 2009

(65) Prior Publication Data

US 2010/0096142 A1 Apr. 22, 2010

Related U.S. Application Data

(60) Provisional application No. 61/107,518, filed on Oct. 22, 2008, provisional application No. 61/183,393, filed on Jun. 2, 2009.

(51) Int. Cl.
*E21B 43/16* (2006.01)

(52) U.S. Cl. ..... 166/321; 166/372; 137/155

(58) Field of Classification Search ..... 166/319, 166/321, 372, 373; 137/155
See application file for complete search history.

(56) References Cited

U.S. PATENT DOCUMENTS

| | | | | |
|---|---|---|---|---|
| 3,834,414 | A * | 9/1974 | McMurry | 137/155 |
| 4,554,972 | A | 11/1985 | Merritt | |
| 4,813,730 | A | 3/1989 | Terral | |
| 5,066,198 | A | 11/1991 | Decker | |
| 5,267,469 | A | 12/1993 | Espinoza | |
| 5,425,425 | A | 6/1995 | Bankston et al. | |
| 7,147,059 | B2 | 12/2006 | Hirsch et al. | |
| 7,198,099 | B2 | 4/2007 | Lugtmeier et al. | |
| 7,464,763 | B2 | 12/2008 | Galloway et al. | |
| 2002/0070369 | A1 | 6/2002 | Faustinelli | |
| 2003/0024704 | A1 | 2/2003 | Hirsch et al. | |
| 2003/0164240 | A1 | 9/2003 | Vinegar et al. | |
| 2005/0056431 | A1 | 3/2005 | Harrington et al. | |
| 2005/0087337 | A1 | 4/2005 | Brisco et al. | |
| 2007/0227739 | A1 * | 10/2007 | Becker et al. | 166/319 |
| 2010/0084139 | A1 * | 4/2010 | Moreno | 166/373 |

OTHER PUBLICATIONS

BK-2, website,last modified Oct. 3, 2003, BST Lift Systems Inc.
Baker Oil Tools Tubing-Retrievable Gas Lift Valves and Mandrels,website, Baker Hughes Incorporated. Pub. No. BOT-07-12519 2M 06/07.
EBK-2, website,last modified Oct. 3, 2003, BST Lift Systems Inc.
American Completion Tools, RK Latch BK-2 Latch RM Latch, website, Burleson, Texas.

* cited by examiner

*Primary Examiner* — William P Neuder
*Assistant Examiner* — Richard Alker
(74) *Attorney, Agent, or Firm* — Millen, White, Zelano & Branigan, P.C.; William F. Nixon

(57) ABSTRACT

A gas-lift valve comprising an elongated vertically orientated tubular body with inlet ports positioned for communication with the inlet ports of a gas-lift valve mandrel, a valve seat and valve port at the upper end of the valve body, a movable gas charged dome positioned within the body below the valve seat, a valve ball assembly attached to the dome, and a collapsible bellows positioned to move the dome and manipulate the valve ball assembly downward onto and off of the valve seat in response to pressure from said inlet ports of the valve body and pressure on the seat and thereby allow injection gas to flow upward through the valve port to exit at the upper end of the valve body. A tubular latch is provided with a removable plug to provide for pressure testing and completion of the well with only one wireline trip.

17 Claims, 7 Drawing Sheets

GAS-LIFT VALVE AND METHOD OF USE

This application claims priority to U.S. provisional application Ser. No. 61/107,518 filed Oct. 22, 2008 and U.S. provisional application Ser. No. 61/183,393 filed Jun. 2, 2009, the entire content of which is hereby incorporated by reference.

FIELD OF INVENTION

This invention relates generally to gas-lift valves used during new and existing well completions. The invention and method may be utilized with the "Side Pocket" gas-lift mandrels typically used in the oil and gas industry.

BACKGROUND

Gas Lift is the method of artificial lift that uses an external source of high-pressure gas for supplementing formation gas to lift the well fluids. Gas may be injected continuously or intermittently, depending on the producing characteristics of the well and the arrangement of the gas-lift equipment. Most wells are gas lifted by continuous flow, which can be considered an extension of natural flow by supplementing the formation gas with additional high-pressure gas from an outside source.

Gas is injected continuously into the production conduit at a maximum depth on the basis of the available injection gas pressure. The injection gas mixes with the produced well fluids and decreases the flowing pressure gradient of the mixture from the point of gas injection to the surface. The lower flowing pressure gradient reduces the flowing bottomhole pressure (BHFP) to establish the drawdown required for attaining a designed production rate from the well. If sufficient drawdown in the bottomhole pressure (BHP) is not possible by continuous flow, intermittent gas lift operation may be used.

Gas-lift is typically achieved by distributing an array of gas-lift valves along the production tubing string. Optimum flow rate is achieved by having one single injection point as deep in the production tubing as possible. Typically natural gas is circulated via a compressor to aerate the production fluid.

Gas-lift valves are typically installed by a latch mechanism in a side pocket gas-lift mandrel that is attached to the production tubing string. Tubing and casing pressures cause the gas-lift valve to open and close, thus allowing gas to be injected into the fluid in the production tubing from the annulus to cause the fluid to rise to the surface. Such gas-lift valves inject gas downward into the production tubing.

The early gas lift valves were the conventional type whereby the tubing mandrel that held the gas lift valve and reverse check valve was part of the tubing string. It was necessary to pull the tubing to replace a conventional gas lift valve. Selectively retrievable gas lift valve and mandrel combinations have been developed. They provide a valve mandrel with a pocket, or receiver, within the mandrel from which the retrievable gas lift valve could be removed or installed by simple wireline operations without pulling the tubing.

The primary wireline device for locating the mandrel pocket and selectively removing or installing a gas lift valve is a kick-over tool. The mandrel is called a sidepocket mandrel because the pocket is offset from the centerline of the tubing. Most sidepocket type retrievable valve mandrels have a full-bore ID equal to the tubing ID. These mandrels permit normal wireline operations.

Gas-lift valves utilize a metal bellows and dome attached to a valve stem having a stem tip or ball that moves upward and downward against a valve seat at the opening of a valve port in response to pressure within the metal bellows. A gas charge applied to the bellows provides the downward force, holding the valve tip or ball on the valve seat. The gas charge applied to the bellows is preset as may be desired. A check valve (which is downstream of the stem tip or ball and seat of the valve) is attached to the lower part of the gas-lift valve. The check valve keeps the flow from the tubing from going back into the casing, i.e., the annulus between the casing and the production tubing.

The gas-lift mandrel serves as a communication port between the casing and the tubing. Gas is injected down the casing into the casing-tubing annulus. The injected gas moves from the annulus to the gas-lift valve through communication ports in the gas lift mandrel and inlet ports in the gas lift valve. The injected gas exits the gas-lift valve downward injecting gas against the formation or against the natural flow of the well.

The opening forces on the valve ball of the gas-lift valve are the casing pressure acting on the area of the bellows (less the area of the valve seat) and the tubing pressure acting on the valve seat area. When the combined casing and tubing pressures are sufficient, the valve tip or ball moves upward from the valve seat to open the valve to allow injection gas to flow through valve port then through the check valve in a downward direction from the gas-lift valve toward the formation. Once the valve is open, it remains open until the casing pressure is reduced to the predetermined closing pressure or the tubing pressure or tubing load is reduced.

Gas-lift valves are installed in a gas-lift mandrel with latches such as a BK-2 or BEK-2 latch. These latches are a spring-loaded ring type latch used to secure valves in the gas-lift mandrel. The side pocket mandrels are in a position with the latch no-go and latch lug facing upward and with a kick-over tool locator in the upward position.

Typically, once a production tubing string is installed (landed), it is desirable to test the seal integrity of the whole system or "Completion" assuring there are no leaks in the system. System components being tested include the packers and gas lift mandrels as well as the pressure containing components. During such testing all communication ports between the casing or annulus must be sealed off either by closing the device or installing a "blank" to replace any sort of circulating device.

In referring to the gas lift system and when a side pocket mandrel is installed in the production string, a "dummy valve", serving as a "blank", is generally installed in place of the gas lift valve to assure a positive test. Once the whole production tubing assembly has been tested and gas lift operations are needed to lift the well, wireline intervention is required to remove all dummies and gas lift valves are installed. Wireline intervention to change out dummy valves and replace with live gas lift valves, at minimum, will require two wireline trips per mandrel to complete the job.

SUMMARY OF INVENTION

A method and gas-lift valve apparatus is proposed to allow for the injection gas to be injected from the gas-lift valve upward rather than downward. The proposed method and gas-lift valve apparatus may be utilized in conjunction with a production tubing string having a plurality of side pocket mandrels at spaced intervals along the string. Each of the gas-lift valves is operated by available injection pressure or a combination of available injection pressure in conjunction with pressure, within the production tubing at the depth placement of each gas-lift mandrel.

The method proposes and utilizes a gas-lift valve that prevents downward flow of injection gas, i.e., toward the well formation, and provides upward flow of injection gas through a latch located at the top of the valve in the direction of and along with the natural flow of the well. This is accomplished by redirecting the delivery of gas upward through the latch. In other valves the injection gas exits at the bottom of the valve through a check valve. The check valve in the proposed gas-lift valve is incorporated within the main body of the gas lift valve.

When the injection gas is injected in an upward direction along with the natural flow of the well, the formation containing the fluids to be recovered is relieved of downward injection pressure. Testing has shown that reversing the direction of injection gas flow into the production string from downward, as is done with prior gas-lift valves, to upward as described in the proposed gas-lift valve will cause the gas lifted well to act as if it is flowing on its own. The upward injection of gas from the gas-lift valve will eliminate or reduce the eddying effect on the fluids that occurs in the use of conventional gas-lift valves such as injection pressure operated (IPO) and production pressure operated (PPO) gas-lift valves. Testing has shown that one may anticipate as much as a 40% increase in production with the use of the proposed gas-lift valve in conjunction with gas lift design options.

The proposed gas-lift valve is configured with a body, a gas charged dome and bellows within the body to manipulate a valve stem and attached valve ball on and off of a valve seat. When a combination of the casing pressure from the inlet ports of the gas-lift valve and the tubing pressure on the valve seat reaches or exceeds the nitrogen gas charge within the dome and the bellows of the valve, the bellows will collapse moving the dome downward, causing the valve ball to come off of the valve seat to allow gas to flow through the port and upward through the check valve located in the upper portion of the proposed gas-lift valve, continuing upward through the attached latch. The injection gas then exits the gas lift valve assembly through the top of the latch.

Redirecting the injection gas upward along with the natural flow of the well will increase production by adding additional drawdown to the formation. Also injecting gas upward with the natural flow of the well will relieve the formation from injection pressures and stabilizing well flow. Stabilizing the flow of a gas lift well or simulating a natural flowing well, not only increases production but relieves the whole system from stress caused by downward injection. Consequently, the proposed new gas-lift valve and method of gas-lift injection will enhance or increase the production of fluids from the well when compared to gas-lift valves that injection gas downward in a direction counter to the natural flow of the well.

This proposed gas-lift valve and method may be in place of most if not all of the gas-lift valves currently being utilized in the industry. This would include by way of example such valves as the Camco-style IPO (Injection Pressure Operated gas-lift valve), the PPO-style (Production Pressure Operated gas-lift valve), the AT1-BK (Altec Bellows protected Injection Pressure Operated gas-lift valve), and the AT1-CF-BK (Constant Flow Injection Pressure Operated gas-lift valve).

The proposed gas lift valve and method is to be used in conjunction with a new flow through latch design, designated as the "EBEK-FT" latch. This new latch will provide a one-hole down-stream choke to the injection gas. The new latch, configured with a desired sizing of a choke down-stream of the main port of the gas lift valve, will provide a variety of gas lift design options. The latch will allow the designer to use the down-stream choke to size a desired gas passage required to lift the well and in turn size the main port, (ball and seat) of the gas lift valve larger as may be desired. A larger main port (ball and seat) may be desirable as it will allow more tubing effect in acting to open and close the valve.

The proposed gas lift valve and method may also be used in conjunction with the new flow through latch design in combination with a plug. The valve latch and plug combination, designated as the "EBEK-FTD" latch, has all of the benefits as the EBEK-FT latch but will, in addition, provide a removable plug that is installed in the top of the latch. This removable plug may be fitted to the valve and latch combination during the initial completion of the well when it is desired to run gas-lift valves. The plug and latch combination, posing as a dummy valve, will enable testing of the annulus after completion of the well. Once the annulus is tested and the well completed, if gas-lift operations are desired, only one wireline trip will be required to pull the plug from the latch in order to activate the gas-lift valve.

This plug and latch combination will save the consumer from the need to purchase dummy valves and BK-2 latches that would ordinarily have to be replaced with wireline operations when gas lift operations are required in the well. It will also reduce the need for wireline intervention, including the time and risks associated with multiple wireline trips into and out of the well.

DETAILED DESCRIPTION

Figure 1:
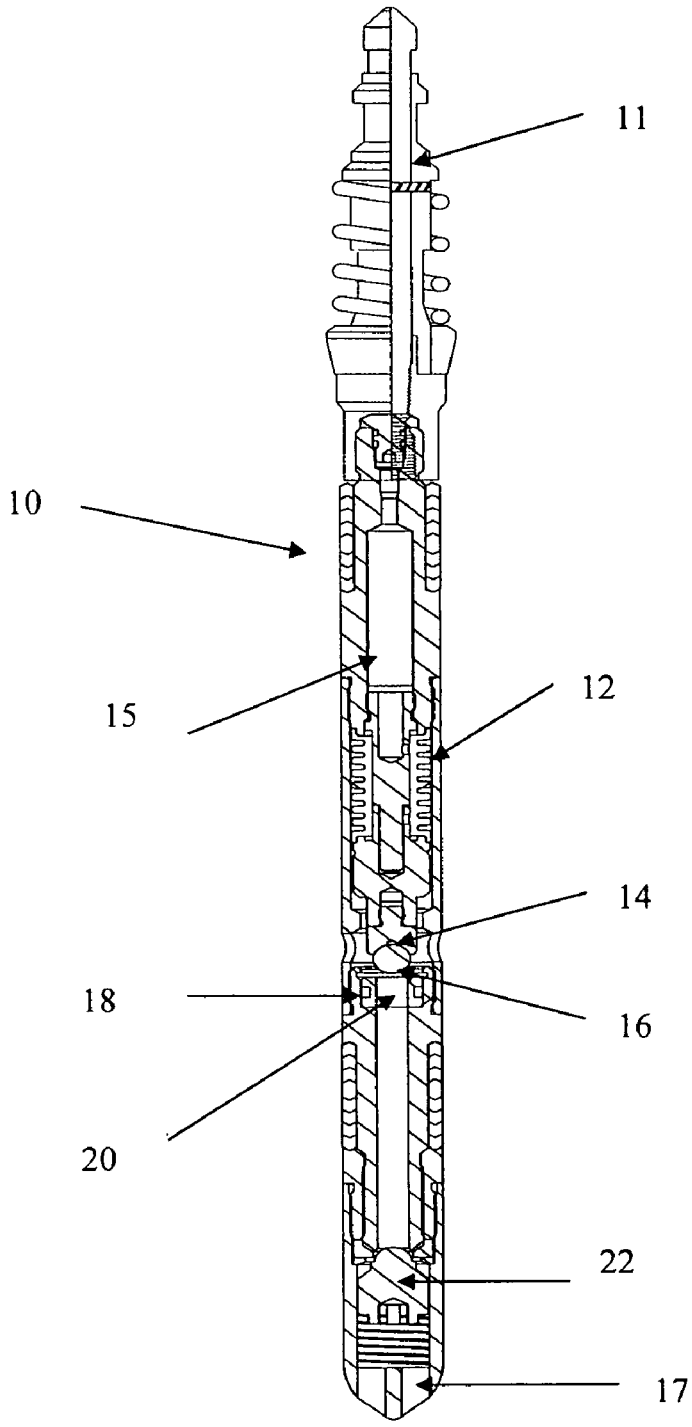
Figure 1 Prior Art
FIG. 1 is a cross-section schematic elevation view of a typical prior art gas-lift valve.

Referring now to the drawings, and more particularly to FIG. 1, there is shown a cross-section elevation view of a gas-lift valve 10 and latch 11 of the conventional prior art type. The valve to has a metal bellows 12 in communication with a gas charge dome 15 at its top. The dome 15 is stationary and has a constant volume to provide pressure to expand the bellows 12.

The bellows 12 is positioned to manipulate a valve stem 14 positioned below the bellows 12. The valve stem 14 has a stem tip or ball 16 that moves upward and downward below the bellows 12 against a valve seat 18 at an opening to a valve port 20 in response to pressure on the metal bellows 12 from the gas charge dome 15. A predetermined gas charge is applied to the dome 15 and bellows 12 so as to provide a downward force on the valve ball 16 to hold it on the valve seat 18 to close the valve port 20. The valve port 20 is in communication with injection gas ports 17.

A check valve 22 incorporated into the lower part of the gas-lift valve that is positioned downstream from and below the valve ball 16, valve seat 18 and valve port 20. The position of the check valve 22 in these conventional gas-lift valves keeps the flow from the tubing in which the valve is incorporated from going back into the casing (annulus) and maintains outward flow of the injection gas down the tubing through valve port 20 and gas ports 17 toward the well formation and counter to the flow of the fluid in the tubing.

Figure 2:
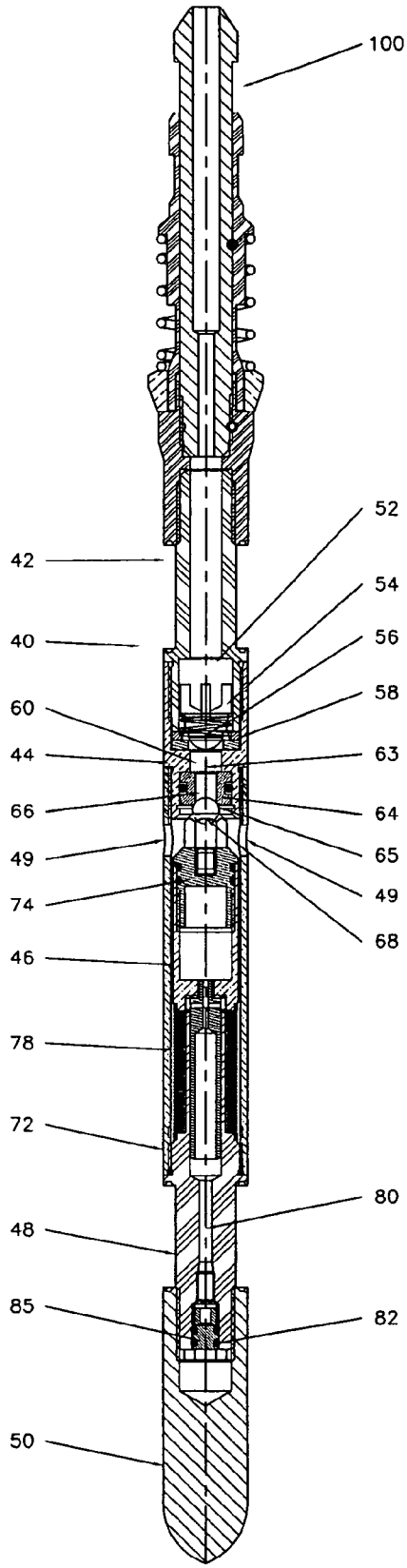
FIG. 2 is a cross-section elevation view of the gas-lift valve assembly and latch of Applicant's invention as described herein.
Figure 3:
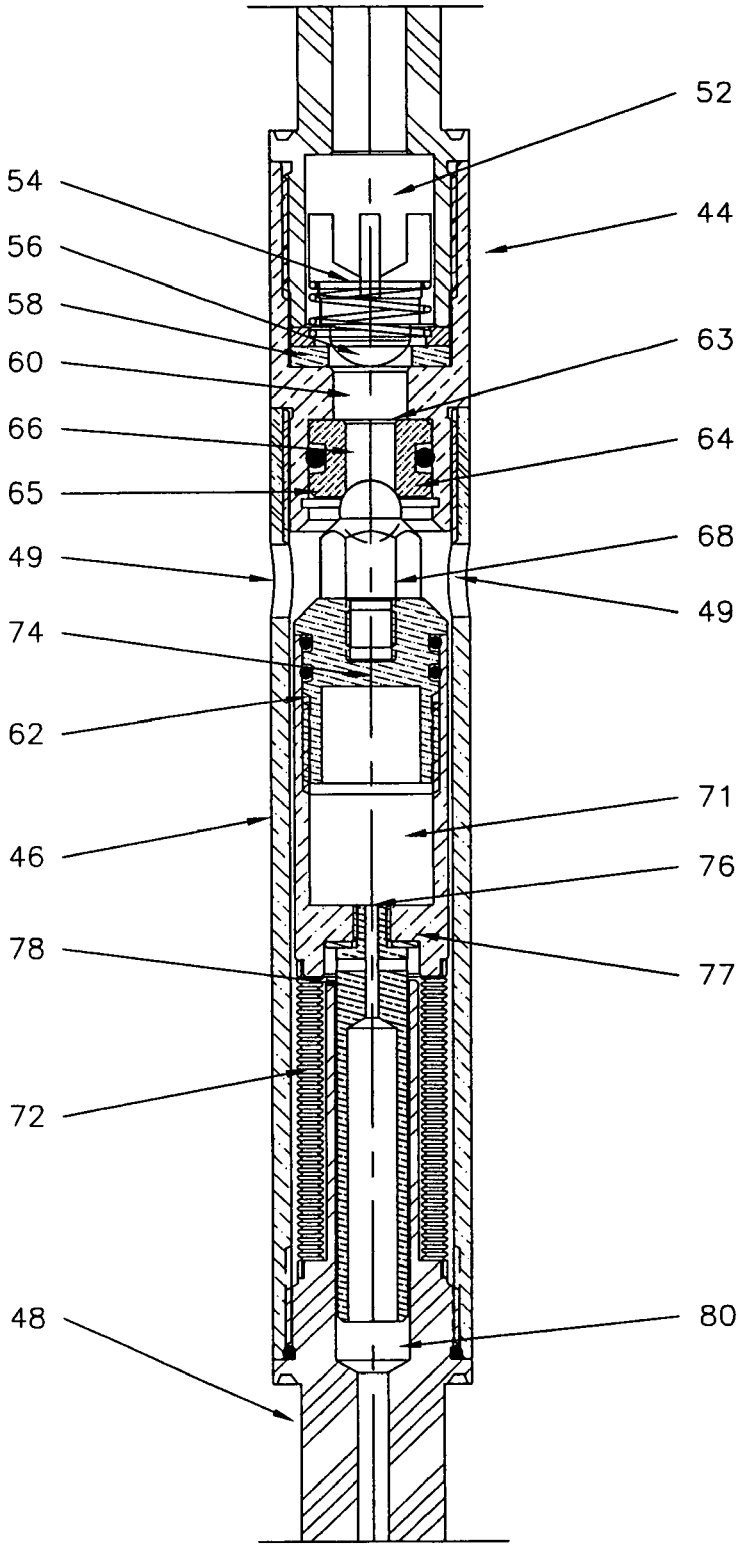
FIG. 3 is a partial cross-sectional view of the valve of FIG. 2 showing the dome and bellows configuration of the valve assembly in FIG. 2.

FIG. 2 shows a cross-section elevation view of the gas-lift valve assembly 40 and latch 100 of Applicant's invention in accordance with its position in the well. As can be seen in FIG. 2 and FIG. 3, an enlarged partial cross-section view, the valve assembly 40 is comprised, from top to bottom, of check valve housing 42, valve seat housing 44, bellows housing 46, valve core housing 48, and valve nose cone 50. The check valve housing 42 and the valve core housing 48 are adapted to receive a packing stack assembly, not shown. The gas-lift valve assembly 40 is configured to be oriented vertically in the well with the check valve housing 42 at the top.

A check valve assembly 52 is mounted within the valve check housing 42. The check valve assembly 52 is comprised of a check spring and washer combination 54 that is biased against a vertically orientated lower check valve dart 56. The spring 54 retracts vertically up and down to position the check valve dart 56 against a lower check valve pad 58. The check valve pad 58 defines the opening of a check valve port 60. The extension of the check spring 54 will move the valve dart 56 away from the valve pad 58 to open the check valve port 60 . Compression of the check spring 54 will move the valve dart 56 toward the valve pad 58 to close the check valve port 60.

An injection gas seat assembly 62 is mounted within the injection valve seat housing 44. The injection gas seat assembly 62 is comprised of injection gas valve seat 64 having an upper end 63 and a lower end 65. The valve seat 64 defines a vertically extending injection gas port 66.

Extending vertically below the valve seat housing 44 is the bellows housing 46 has inlet ports 49 positioned for communication with the inlet ports of the mandrel. A bellows assembly 70 is mounted with the bellows housing 46 and is positioned at the lower end 65 of the valve seat 64. The bellows assembly 70 is comprised of an injection gas valve ball assembly 68, a bellows adaptor 74 that is removably mounted to the hollow dome 71.

A tubular bellows 72 extends from the base of the dome 71. The lower end of the bellows 72 is mounted on the valve core housing so that the upper will compress and expand in response to external pressures. A bellows rod 78 extends from the dome 71 through the valve core housing and bellows 72 to support and guide the dome 71 as the dome moves in response to movement of the bellows 72.

The bellows adaptor 74 is preferably threadably mounted to the dome 71 so that it may be removed to allow fluid to be inserted through the hollow dome 71 and the bellows rod 78 into the valve core housing 48 so that it will fill the space between the valve core housing and the bellows. Air in the space the space between the valve core housing 48 and the bellows 72 is expelled through a communication port 83 in the bellows rod 78.

The gas valve ball assembly 68 is attached to the bellows adaptor 74 which in turn is attached to the dome 71 at its upper end. The valve ball assembly 68 is configured to move up and down against the lower end 65 of the valve seat 64 as the adaptor 74 moves in response to injection gas pressure acting against the dome 71 and bellows 72 and tubing pressure at the valve port 66.

Figure 4:
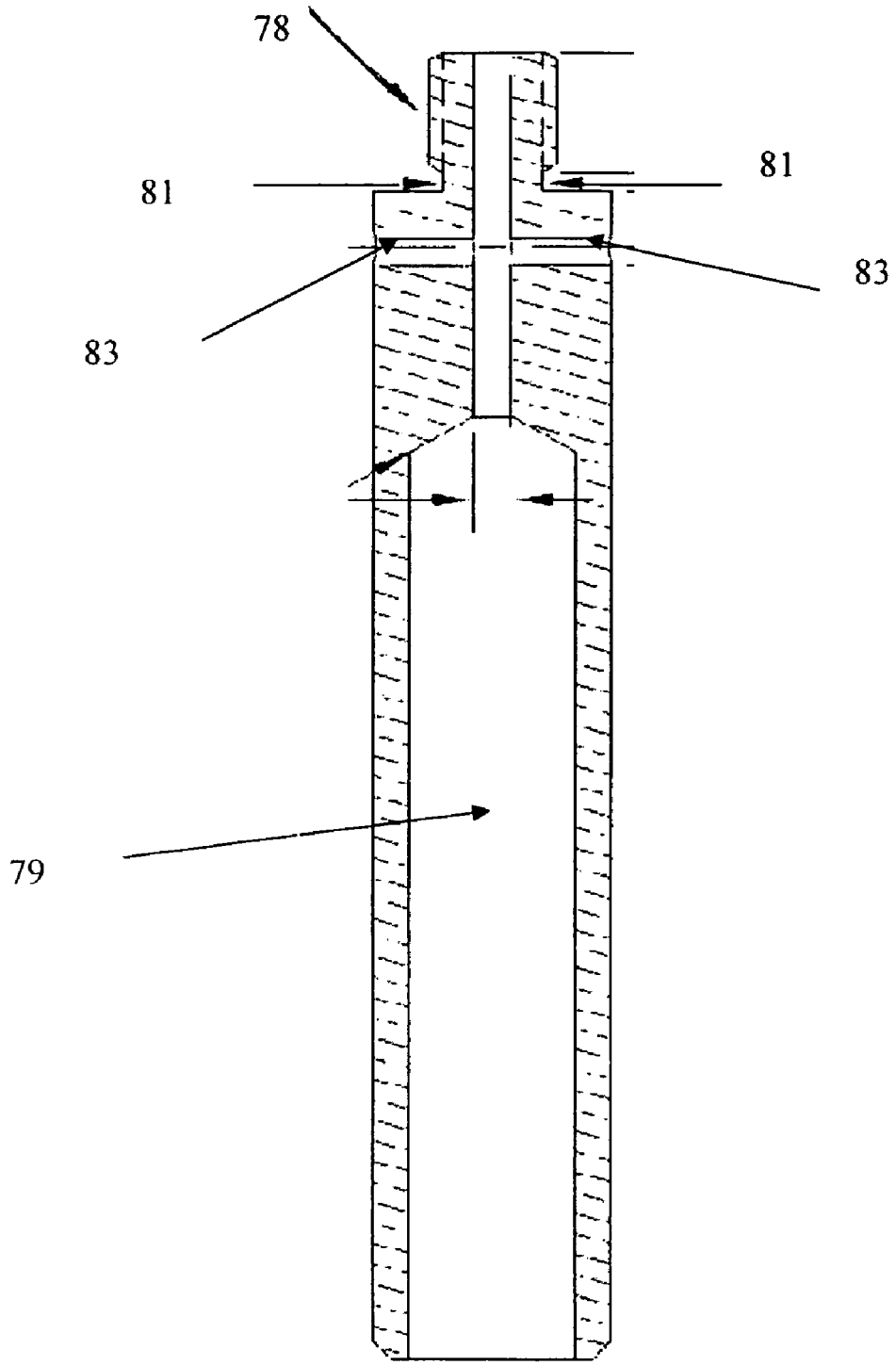
FIG. 4 is a cross-sectional elevation view of the bellows rod of the value assembly shown in FIG. 2.

As shown in FIGS. 2 and 3, the dome 71 has a bore or port 76 adapted to receive the hollow bellows rod 78. This bellows rod 78, shown in FIG. 4, is attached to the dome 71 and is slidably received through the valve core housing 48 that supports the tubular metal bellows 72. In this manner the bellows rod 78 extends between the dome 71 and the valve core housing 48 and through the bellows 72.

As shown in FIG. 4, the hollow bellows rod 78 has a through bore 79 and a cross-hole communication port 83 drilled at its top end which is positioned below the dome 71 and into the bore 79 of the bellows rod 78. Connector area 81 allows for thread connection to the dome 71.

A gasket 77, preferably made of copper, is provided at the interface of the dome 71 and bellows rod 78. The gasket 77 serves as a seal between the valve core housing 48 and the dome 71 when the bellows 72 is fully collapsed and contracted to provide hydraulic bellows protection.

As shown in FIG. 2, a bore 80 in the valve core housing 48 is configured to slidably receive the hollow bellows rod 78 in response to movement of the bellows 72 and dome 71. A one way valve stent 85 is provided in the plug 82 at the base of the bore 80 to provide communication with the bore 80 of the valve core housing 48. The one way valve stent 85 provides a means for insertion of gas, preferably Nitrogen, in order to charge the dome 71. The nose cone 50 is attached to the valve core housing 48 at its base to complete the valve assembly 40.

The vertically extending valve core housing 48 provides protection to the bellows 72 as it serves as a guide for the bellows rod 78 when the bellows rod 78 slides into the bore 80 of the valve core housing 48. This keeps the bellows 72 from twisting or bending out of alignment. This configuration also serves as a stop to limit the total travel of the bellows 72 as well as a means or barrier to trap the fluid behind the bellows 72 when the injection valve is fully open.

Figure 5:
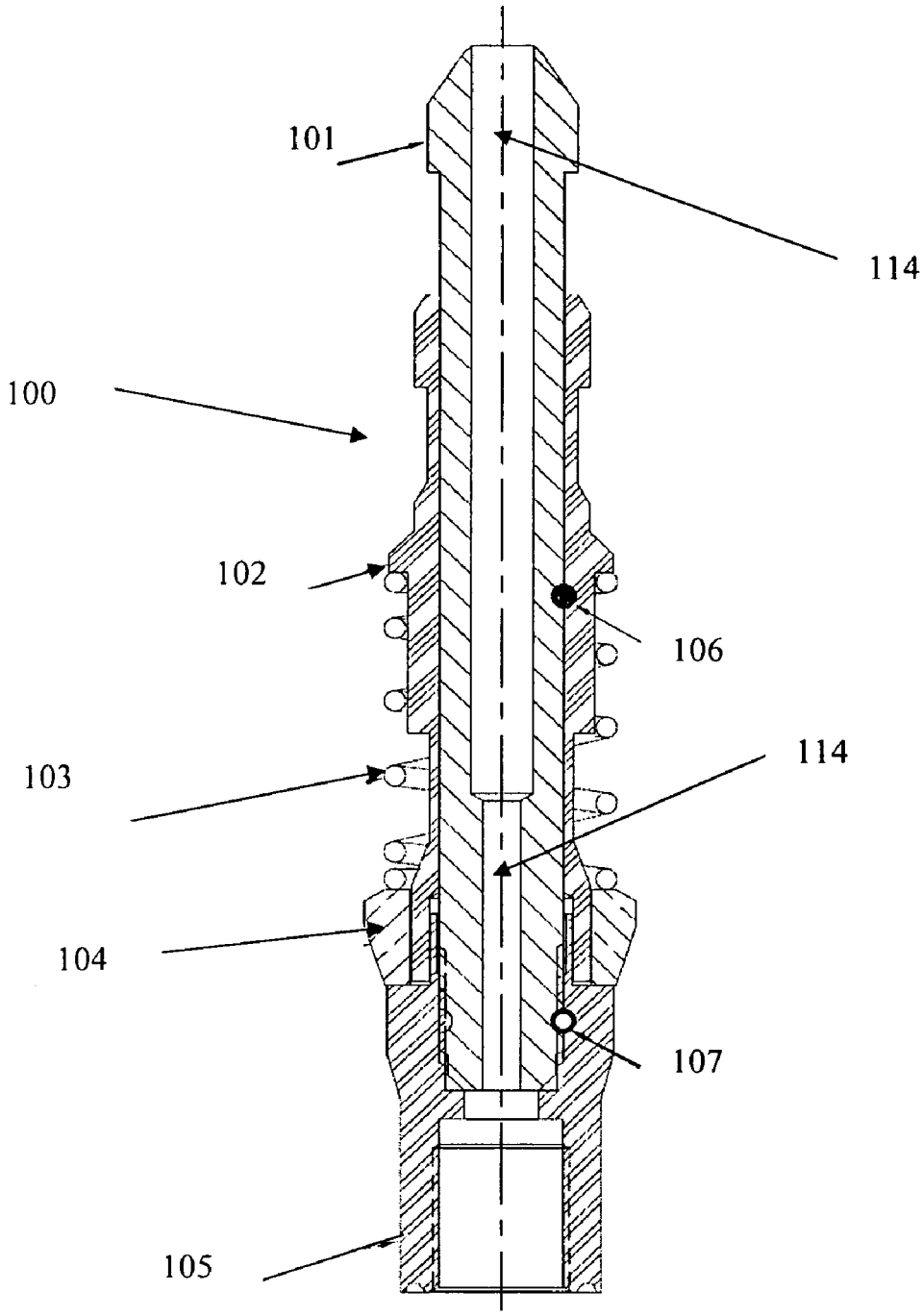
FIG. 5 is a cross-sectional view of the latch configuration for use with the valve assembly of FIG. 2.

FIG. 5 is a cross-sectional view of the proposed flow through latch, designated as the "EBEK-FT" latch, configured for use with the valve assembly 40. The latch 100 is comprised of a hollow latch post 101 having an elongated bore 114 that is inserted within a latch body 102. The latch 100 is provided with a latch spring 103 and a latch ring 104. At stop 105 is provided for attachment of the latch 100 to the upper end of the check valve housing 42 of the gas-lift valve assembly 40. Shear pin 106 and roll pin 107 are also provided. The hollow latch post 101 and bore 114 allows flow from the top of the valve assembly 40 to exit "upward" along with the natural flow of the well.

Figure 6:
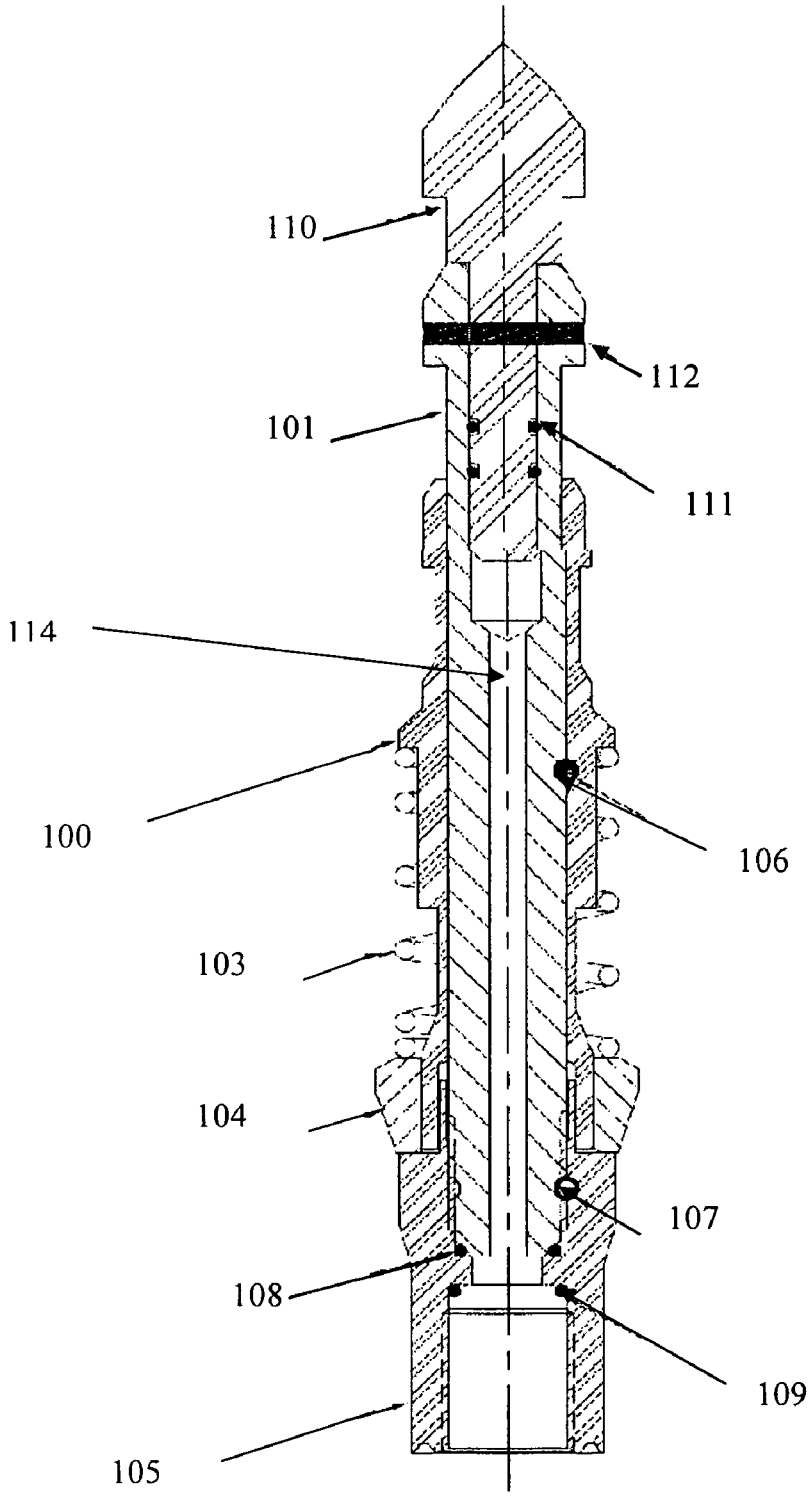
FIG. 6 is a cross-sectional view of the latch configuration of FIG. 5 with a latch plug in place.

As shown in FIG. 6, the latch 100 may also be provided with a removable prong or latch plug 110 and incorporated O-ring seals 111. The combination of valve latch 100 and plug 110, designated as the "EBEK-FTD" latch, has all of the benefits as the EBEK-FT latch but will, in addition, provide a removable plug 110 that is installed in the top of the latch. The plug 110 is installed within the latch post 101 and secured by a brass shear pin 112. An O-ring 108 is placed between the latch post 101 and the latch stop 105 and an O-ring 109 is also placed at the connection between the valve assembly 40 and latch 100.

The latch 100 may be provided with a "choke" in the bottom of the latch accomplished by reducing or "choking" the bore 114 at the lower end of the latch post 101 to a desired dimension. The upper portion of the bore 114 of the latch post 101 may be maintained at a constant size such as ⅜" in diameter. Chokes may be made in a variety of sizes such as ⅛", 10/64", 12/64", 16"64", or 20/64" by providing a plurality of corresponding latch posts 101 each having a bore 114 in a size as may be desired for a particular gas-lift design. The designer may determine whether or not to use a latch 100 with a choked latch post or, if so choked, to select from a variety of chokes simply be using a desired latch post 101 having a desired choke dimension of the bore 114. The pressure shear value of the shear pin 112 selected for use will depend upon the choke size of the latch post 101.

An advantage of a choke downstream from the gas valve ball assembly 68 and the gas valve seat 64 of the gas-lift valve assembly 40 in the direction of the flow of the well is that when the valve is fully open the pressure drop across the gas-lift valve will be seen at the choke in bore 114 in the lower end of latch 100 so that the valve seat 64 and ball assembly 68 will be protected from the flow of any fluids including salt water and/or small solids in the fluids that may cut the seat 64 or ball assembly 68 and as a result contribute to leakage of the valve.

Operation of Bellows/Gas Lift Valve

A gas lift design is determined from data generated by the well conditions. This data includes certain well parameters such as the available injection pressure from the compressor, back pressure from the well flow, and temperatures of the formation. This well information is used to determine a Test Rack Opening (TRO) pressure that is used to establish the pressure inside the bellows 72 of the valve assembly 40.

A gas such as Nitrogen is then used to pressurize the bellows 72. When the bellows 72 is pressurized, the bellows 72 extends to move the dome 71 and attached ball assembly 68 upward to position the gas valve ball assembly 68 in contact with the lower end 65 of the valve seat 64. The contact of the gas valve ball assembly 68 with the valve seat 64 will close the valve port 66.

Figure 7:
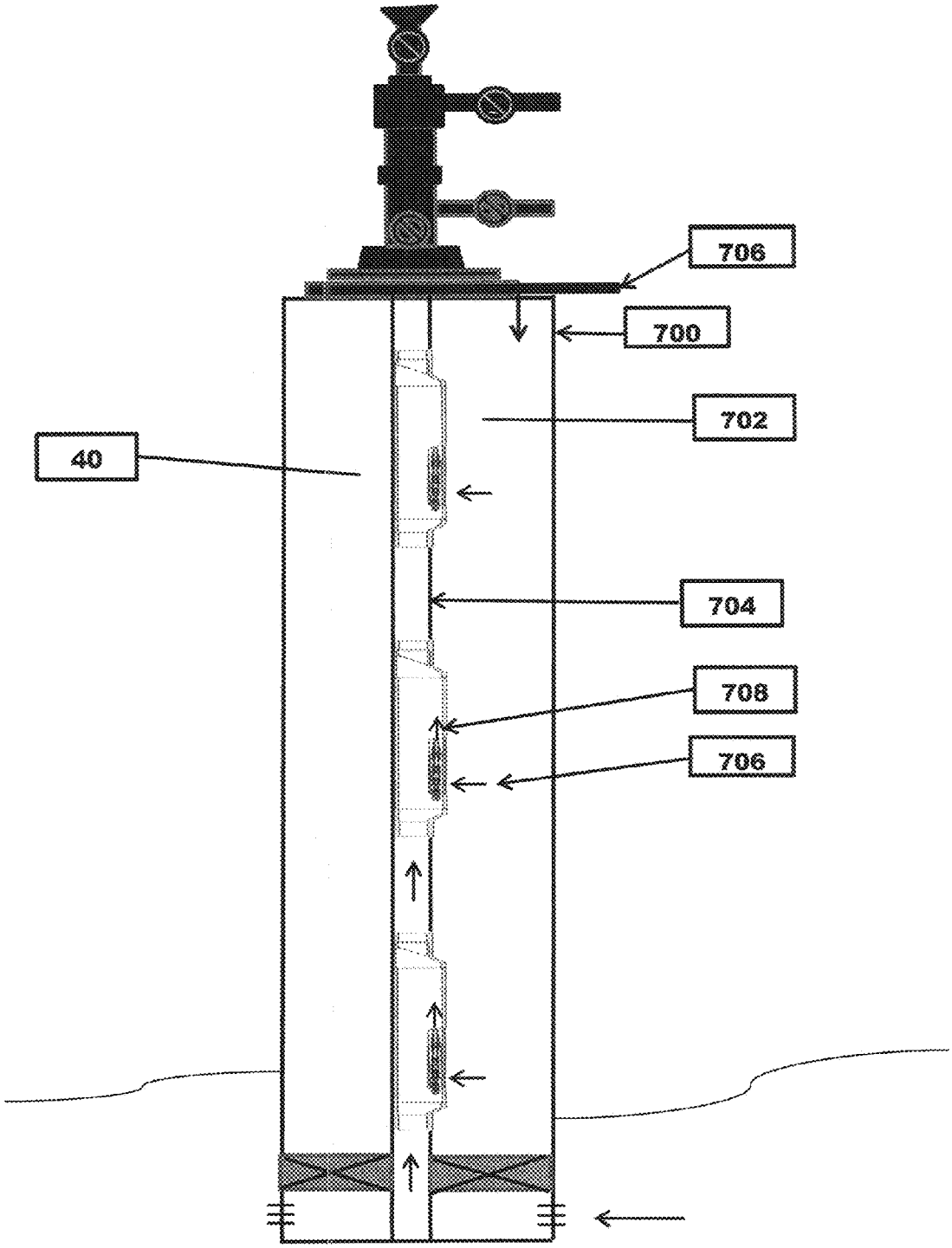
FIG. 7 is a side view of a well having mandrels and installed valves.

Referring to FIG. 7 the gas lift valve assembly 40 may then be installed in a gas lift mandrel 702 on the surface and run with the production tubing 704 during completion of the well 700. The gas-lift valve assembly 40 may also be installed by means of a wire, utilizing a wireline unit, in a side-pocket mandrel previously installed on the tubing string. It is anticipated that a plurality of gas-lift valve assemblies 40 and gas-lift mandrels 702 will be utilized in a single well, as shown in FIG. 7.

If after installation, the hydrostatic pressures in the tubing string are greater than the pressure (TRO) inside the dome 71 and bellows 72 of a particular gas-lift valve assembly 40, the bellows 72 of that gas-lift valve assembly will collapse. When a bellows 72 collapses due to well conditions, the dome 71 and the attached gas valve ball assembly 68 will move downward to move the gas valve ball assembly 68 away from the lower end 65 of the valve seat 64 to open the valve port 66. This will allow injection gas 706 from the annulus between the casing and production tubing to be injected to into the fluid column of the production tubing string.

When the gas-lift valve is in the closed position in the well, the gas valve ball assembly 68 will be positioned against the valve seat 64. When the valve begins to move to the open position with the gas valve ball assembly 68 moving away from the valve seat 64 due to gas pressures or hydrostatic pressures acting on the outside of the bellows (or outside of the valve itself), the bellows rod 78 moves in a downward direction, thus causing fluid to be pushed up through the hollow bellows rod 78 to exit the bellows rod 78 into the dome 71. When the valve is fully opened, the bellows rod 78 continues to slide down in the extending valve core housing 48 until the gasket 77 contacts the valve core housing 48 to provide hydraulic bellows protection.

Use of the gas-lift valve assembly 40 with latch 100 and plug 110 in combination with a gas lift mandrel 702 provides the opportunity to insert the plug 110 into the top of the latch 100 in order to prevent communication between the annulus and the inside of the production tubing 704 which, in essence, will serve the purpose of the dummy valve typically installed for testing purposes. The plug 110 is installed in the latch 100 and secured in place by the shear pin 112. The O-ring seals 111, 108 and 109 serve to block communication between the annulus and tubing.

When the assembly 40 and latch 100 are installed in a side pocket mandrel pose as a dummy valve, all conventional operations requiring the use of a dummy valve may be performed on the well. Only one run with a wireline unit is required when it is deemed necessary for the gas-lift valve assembly 40 to be activated. That run will allow the plug 110 to be pulled from the top of latch 100 in order to activate the gas-lift valve assembly for injection of gas 708 upward with the flow 710 of the well 700 from the top of the latch 100.

The gas-lift valve assembly 40 and latch 100 in combination with the plug 110 and removal procedure provides significant financial benefits to the user. This combination and procedure allows the gas-lift valve to be run on initial completion of the well posing as a dummy valve and thus eliminates the cost of dummy valves and latches on initial completion when live IPO valves will be required and reduces or eliminates wireline cost to pull dummies and run live valves.

The proposed combination and procedure also reduces the problems with wireline operations that may occur during the changing out of dummy valves, for example, dropping dummies or valves or having the wireline of dummy valve get stuck in the tubing which may result in the need for wireline fishing jobs. The combination and procedure also provides the user design versatility for the gas lift operation as certain gas-lift valves may be activated in the string, as desired, depending on the procedure being done at the time.

It is thought that the gas-lift valve and method of the present invention and many of its attendant advantages will be understood from the foregoing description. It is also thought that one may make various changes in the form, construction and arrangement of the parts of the gas-lift valve assembly, apparatus and method without sacrificing its material advantages or departing from the spirit and scope of the invention and that the form described herein is merely an exemplary embodiment of the invention that is limited only by the following claims.

The invention claimed is:

1. A retrievable gas-lift valve apparatus, said apparatus comprising:

a) a tubular valve body assembly, said valve body assembly configured to be oriented vertically in a well, said valve body assembly comprised of an upper check valve housing, a valve seat housing positioned below said check valve housing, a bellows housing positioned below said check valve housing, said bellows housing having inlet ports positioned for communication with the inlet ports of a gas-lift valve mandrel, and a valve core housing positioned below said bellows housing;

b) a vertically retracting check spring mounted within said check valve housing, said check spring biased against a check valve dart, said spring to position said check valve dart away from a lower check valve pad in a static state, said check valve pad defining an opening to create a port through said check valve housing;

c) an injection gas valve seat mounted within said valve seat housing, said injection gas valve seat having an upper end and a lower end, said valve seat housing defining a vertically extending injection gas port;

d) A bellows assembly mounted within said bellows housing to extend vertically below said lower end of said valve seat housing, said bellows assembly comprised of a hollow dome, said dome having an upper end and a lower end, said dome having a port at its lower end adapted to receive a hollow bellows rod, said hollow bellows rod extending downward vertically from said lower end of said dome through said valve core housing, said valve core housing having an upper end and a lower end and a vertically extending through-bore to slidably receive said hollow bellows rod, a plug at the base of said valve core housing through-bore, and a bellows adaptor having an injection gas valve ball, said bellows adaptor being mounted to said upper end of said dome; and e) a tubular bellows extending downward vertically from said lower end of said dome, said tubular bellows having an upper end and a lower end, said bellows being pressurized to a desired level, said lower end of said bellows being mounted on said valve core housing whereby said upper end of said bellows will compress and expand in response to external pressures whereby downward movement of said bellows will move said dome and said attached bellows adaptor downward within said bellows housing to move said valve ball away from said lower end of said valve seat housing and thereby allow injection gas to move upward through said valve seat port and said check valve seat and through said check valve housing.

2. The apparatus as claimed in claim 1, further comprising a latch, said latch having a vertically extending tubular latch body, a tubular vertically extending latch post inserted within said latch body, said latch post having a hollow vertically extending bore, and a stop for attachment of said latch to said upper end of the check valve housing, whereby injection gas will flow from said top of said check valve housing and exit upward from said latch post.

3. The apparatus as recited in claim 2 wherein said vertically extending bore of said latch post is choked to a desired dimension.

4. The apparatus as recited in claim 3 wherein said bellows adaptor is threadably mounted to said dome.

5. The apparatus as recited in claim 2 further comprising a plug for said latch, said plug being removably mounted in said vertically extending bore of said latch post.

6. The apparatus as recited in claim 5 further comprising seals placed between said latch post and said latch stop and between said check valve housing and said latch.

7. The apparatus as claimed in claim 1 further comprising a nose cone mounted to said lower end of said valve core housing.

8. A gas-lift valve apparatus, said apparatus comprising:

a tubular valve body assembly, said valve body assembly configured to be oriented vertically in a well, said valve body assembly comprised of an upper check valve housing, a valve seat housing positioned below said check valve housing, a bellows housing positioned below said check valve housing, said bellows housing having inlet ports positioned for communication with the inlet ports of a gas-lift valve mandrel, and a valve core housing positioned below said bellows housing;

a vertically retracting check spring mounted within said check valve housing, said check spring biased against a check valve dart to position said check valve dart against a lower check valve pad, said check valve pad defining an opening to create a port through said check valve housing;

an injection gas valve seat mounted within said valve seat housing, said injection gas valve seat having an upper end and a lower end, said valve seat housing defining a vertically extending injection gas port;

a bellows assembly mounted within said bellows housing to extend vertically below said lower end of said valve seat housing, said bellows assembly comprised of a hollow dome, said dome having an upper end and a lower end, said dome having a port at its lower end adapted to receive a hollow bellows rod, said hollow bellows rod extending downward vertically from said lower end of said dome through said valve core housing, said valve core housing having an upper end and a lower end and a vertically extending through-bore to slidably receive said hollow bellows rod, a plug at the base of said valve core housing through-bore, and a bellows adaptor having an injection gas valve ball, said bellows adaptor being mounted to said upper end of said dome;

a tubular bellows extending downward vertically from said lower end of said dome, said tubular bellows having an upper end and a lower end, said bellows being pressurized to a desired level, said lower end of said bellows being mounted on said valve core housing whereby said upper end of said bellows will compress and expand in response to external pressure whereby downward movement of said bellows will move said dome and said attached bellows adaptor downward to move said valve ball away from said lower end of said valve seat housing and thereby allow injection gas to move upward through said valve seat port and said check valve seat and through said check valve housing; and a latch, said latch having a vertically extending tubular latch body, a tubular vertically extending latch post inserted within said latch body, said latch post having a hollow vertically extending bore, and a stop for attachment of said latch to said upper end of the check valve housing, whereby injection gas will flow from said top of said check valve housing and exit upward from said latch post, wherein said vertically extending bore of said latch post is choked to a desired dimension, wherein said bellows adaptor is threadably mounted to said dome, and wherein said hollow bellows rod has a cross-hole communication port drilled at its top end which is positioned below said dome and a threaded connector area for threadable connection to said dome; and a one way valve stent inserted into said plug at the base of said valve core housing through-bore, one way valve stent in communication with said bore of said valve core housing.

9. The apparatus as recited in claim 8 further comprising a gasket at the interface of said dome and said bellows rod.

10. A retrievable gas-lift valve comprising:

a) an elongated vertically orientated tubular valve body, said valve body having an upper end and a lower end;

b) said valve body having inlet ports positioned for communication with the inlet ports of a gas-lift valve mandrel;

c) a valve seat defining a valve port through said valve body;

d) a movable dome positioned within said valve body below said valve seat, said dome having an attached valve ball; said movable dome having a port at its lower end adapted to receive a hollow bellows rod wherein said hollow bellows rod has a cross-hole communication port drilled at its top end which is positioned below said dome; and e) a collapsible bellows positioned in a bellows housing within said body to move said dome within the bellows housing and manipulate said valve ball vertically upward and downward onto and away from said valve seat in response to pressure from said inlet ports of said valve body and pressure on said valve seat and thereby allow injection gas to flow upward through said valve port to exit at said upper end of said valve body.

11. The apparatus as claimed in claim 10, further comprising a latch mounted to said upper end of said valve body, said latch having a vertically extending tubular latch body and latch post, whereby said injection gas will flow from said upper end of said valve body through said latch post to exit upward from said latch.

12. The apparatus as claimed in claim 11 further comprising a nose cone mounted to said lower end of said valve body.

13. The apparatus as recited in claim 11 wherein said bellows is pressurized to a desired pressure level.

14. The apparatus as recited in claim 13 further comprising a plug for said latch, said plug being removably mounted in said latch post.

15. The apparatus as recited in claim 13 further comprising seals placed between said latch post and said latch body and between said valve body and said latch.

16. The apparatus as recited in claim 11 further comprising a check valve mounted in said valve body above said valve seat whereby injection gas will exit said upper end of said valve body through said check valve and through said latch.

17. The apparatus as recited in claim 16 wherein said vertically extending tubular latch post is choked to a desired dimension.

* * * * *